US005760328A

United States Patent [19]

Robbins

[11] Patent Number: 5,760,328

[45] Date of Patent: Jun. 2, 1998

[54] FOUR POSITION FIREARM FIRE CONTROL SELECTOR

[75] Inventor: Laurance E. Robbins, Plainville, Conn.

[73] Assignee: Colt's Manufacturing Company, Inc., West Hartford, Conn.

[21] Appl. No.: 642,912

[22] Filed: May 6, 1996

[51] Int. Cl.[6] ..... F41A 19/46

[52] U.S. Cl. ..... 89/129.02; 89/140; 89/142

[58] Field of Search ..... 89/129.02, 139–142, 89/143, 144

[56] References Cited

U.S. PATENT DOCUMENTS

| | | | |
|---|---|---|---|
| 1,028,032 | 5/1912 | Krag | 89/142 |
| 2,383,487 | 8/1945 | Johnson, Jr. | 89/139 |
| 3,292,492 | 12/1966 | Sturtevant | 89/128 |
| 3,446,114 | 5/1969 | Ketterer | 89/140 |
| 3,715,954 | 2/1973 | Rude, Jr. | 89/127 |
| 3,724,325 | 4/1973 | Silsby | 89/149 |
| 3,774,500 | 11/1973 | Into | 89/142 |
| 3,847,054 | 11/1974 | Ruger et al. | 89/141 |
| 4,002,101 | 1/1977 | Tellie | 89/142 |
| 4,117,761 | 10/1978 | Johnson et al. | 89/140 |
| 4,697,495 | 10/1987 | Beretta | 89/143 |
| 4,833,970 | 5/1989 | Wilhelm | 89/141 |
| 5,251,533 | 10/1993 | Layton | 89/142 |

FOREIGN PATENT DOCUMENTS 1052274 9/1956 Germany .

*Primary Examiner*—Michael J. Carone
*Assistant Examiner*—Christopher K. Montgomery
*Attorney, Agent, or Firm*—Perman & Green, LLP

[57] ABSTRACT

A firearm with a trigger, a hammer, an automatic sear, and a selector switch connected to a rotatable firing control cam for selecting among types of firing selections of the firearm. The types of firing selections include safe, semi-automatic, limited automatic burst, and fully automatic. The control cam has a section with a general cross-sectional mushroom shape that is contacted by a leg from the automatic sear. The leg has a bend and extends under a center of the control cam in at least two positions of the control cam.

12 Claims, 4 Drawing Sheets

FOUR POSITION FIREARM FIRE CONTROL SELECTOR

BACKGROUND OF THE INVENTION

1. Field of the Invention

The present invention relates to firearms and, more particularly, to a firing mode selector switch.

2. Prior Art

U.S. Pat. No. 3,292,492 discloses a fire control selector that can provide four settings; safe, burst, semi-automatic and fully automatic. U.S. Pat. No. 5,251,533 shows a similar fire control selector with four settings, but using a straight angled sear leg surface and cuts angled relative to a tangent into the control cam.

SUMMARY OF THE INVENTION

In accordance with one embodiment of the present invention a firearm is provided having a trigger, a hammer, an automatic sear, and a selector switch connected to a rotatable firing control cam for selecting among types of firing selections of the firearm. The types of firing selections include safe, semi-automatic, limited automatic burst, and fully automatic. The rotatable firing control cam has an automatic sear control section that is contacted by a leg from the automatic sear. The improvement comprises the automatic sear control section of the control cam having a general mushroom cross-sectional shape with a dome section and a stem section.

In accordance with another embodiment of the present invention a firing control mechanism is provided comprising an automatic sear, a leg connected to the automatic sear, a selector switch, and a rotatable firing control cam connected to the selector switch and having the leg riding thereon. The improvement comprises the leg having a bend near a middle of the leg with the control cam contacting the leg adjacent the bend in at least one position of the control cam.

In accordance with another embodiment of the present invention a firearm is provided comprising a trigger, a hammer, an automatic sear, and a selector switch connected to a rotatable firing control cam selecting among types of firing selections of the firearm. The types of firing selections includes safe, semi-automatic, limited automatic burst, and fully automatic. The rotatable firing control cam has an automatic sear control section that is contacted by a leg from the automatic sear. The improvement comprises means for moving the control cam between a burst position and a fully automatic position without the control cam significantly moving the leg.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
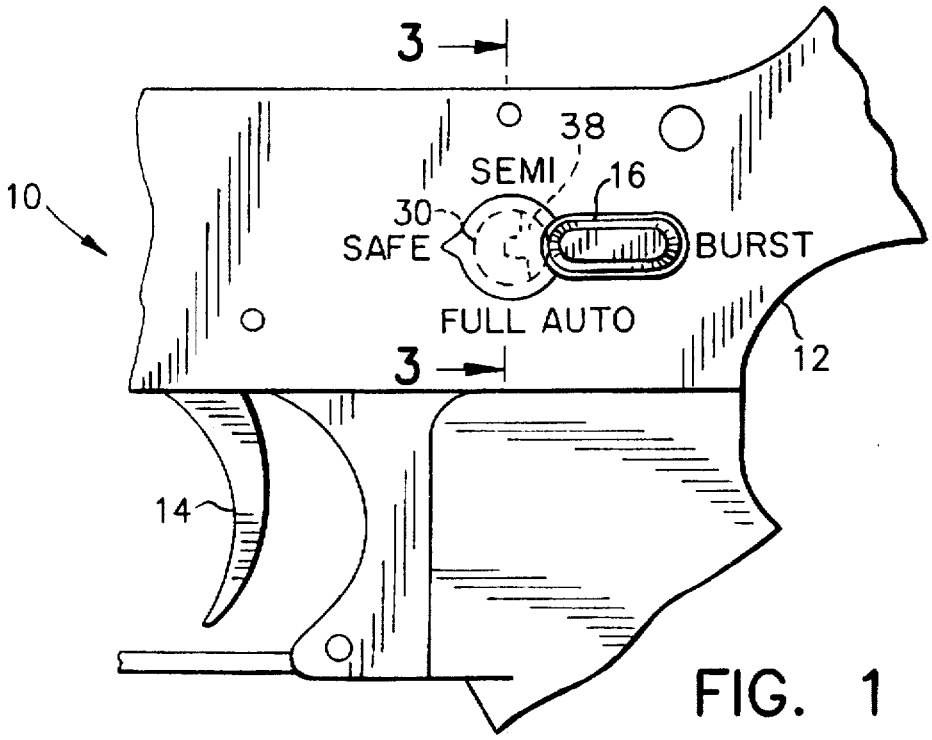
FIG. 1 is a partial side view of a firearm incorporating features of the present invention.

FIG. 1 shows a partial side view of a firearm 10 incorporating features of the present invention. The firearm is similar to an M16 with a lower receiver 12, a trigger 14, and a selector switch 16. Although the invention will be described with reference to the single embodiment shown in the drawings, it should be understood that features of the present invention could be embodied in other different types of firearms. In addition, any suitable size, shape or type of elements or materials could be used.

Figure 3:
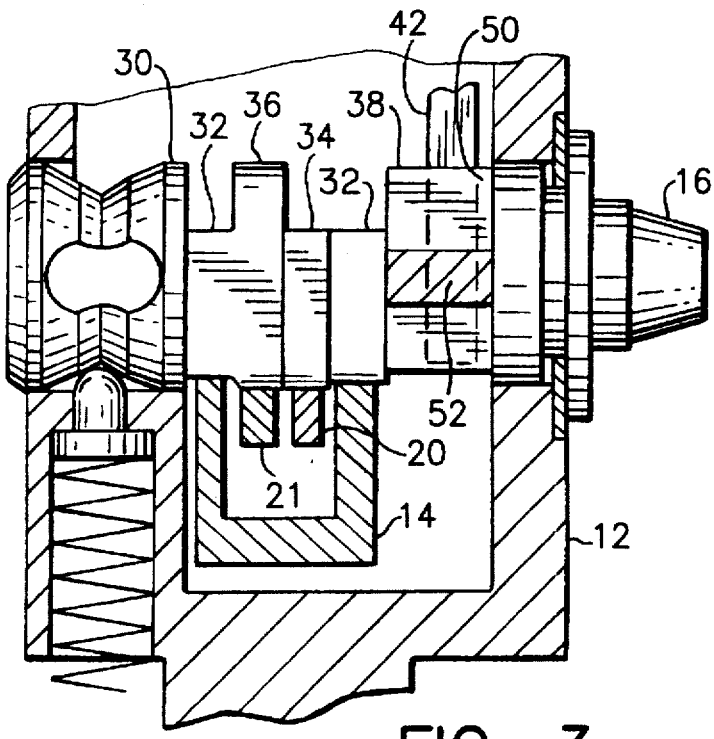
FIG. 3 is a partial cross-sectional view of the firearm shown in FIG. 2 taken along line 3—3.
Figure 2:
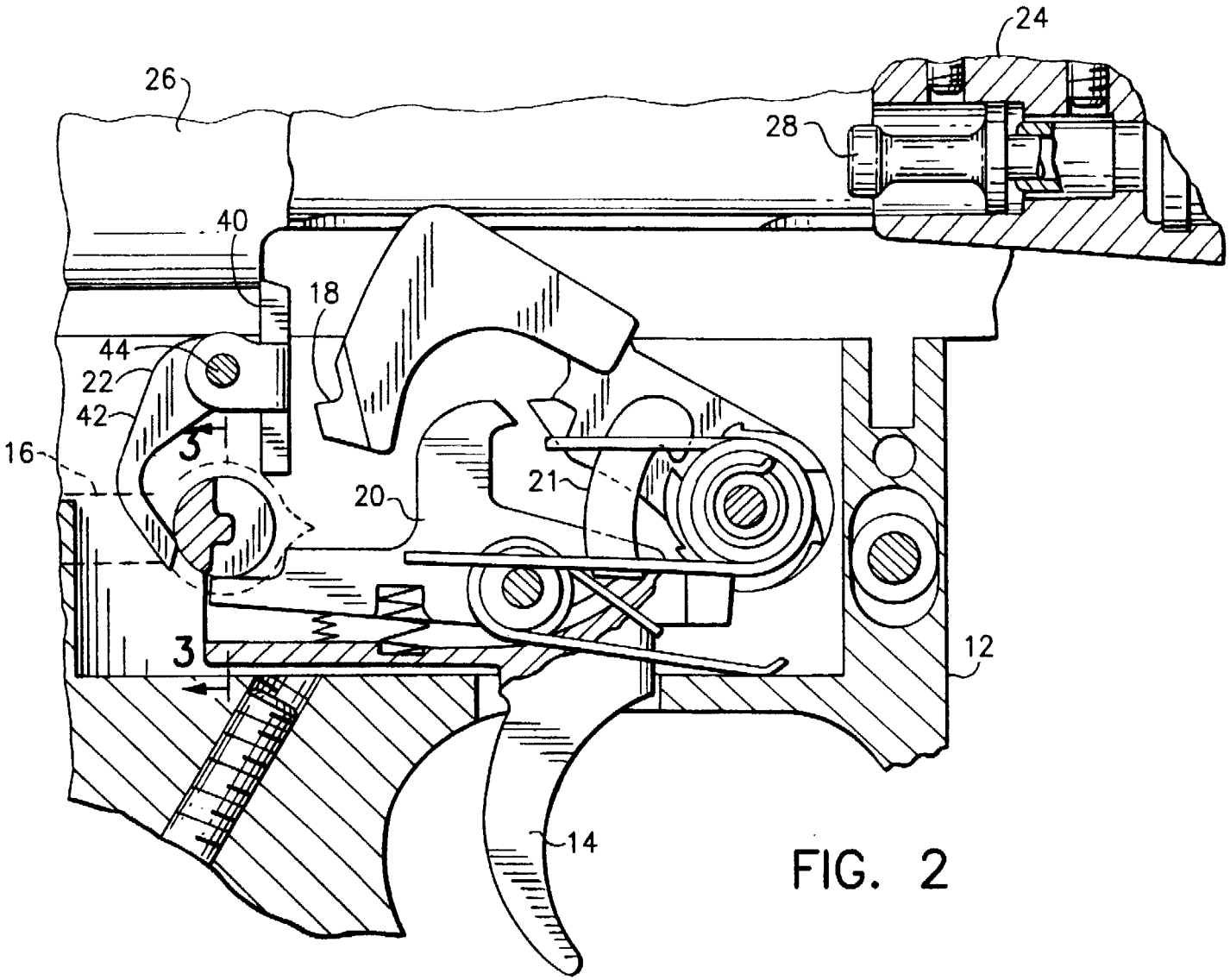
FIG. 2 is a partial cross-sectional view of the firearm shown in FIG. 1.

Referring also to FIG. 2, the firearm 10 has a hammer 18, a semi-automatic disconnector 20, a burst ratchet disconnector 21, an automatic sear 22, and a bolt assembly 24 with a bolt carrier 26 and a firing pin 28. Similar firing mechanisms are described in U.S. Pat. No. 3,292,492 and U.S. Pat. No. 5,251,533 which are hereby incorporated by reference in their entirety. Referring also to FIG. 3, the selector switch 16 is connected to a rotatable firing control cam 30. The cam 30 can be axially rotated for selecting among types of firing selections of the firearm.

More specifically, as seen in FIG. 1, the selector switch 16 can be axially rotated from "SAFE" to "SEMI" to "BURST" to "FULL AUTO", and in reverse. The control cam 30 has a first section 32 for interacting with the rear end of the trigger 14, a second section 34 for interacting with the rear end of the first disconnector 20, a third section 36 for interacting with the rear end of the second disconnector 21, and a fourth section 38 for interacting with the automatic sear 22 (see FIG. 2).

The automatic sear 22 includes a disconnector 40 and a leg 42 pivotally mounted on a pin 44. As is known in the art, the bottom edge of the disconnector 40 is adapted to catch the rear of the hammer 18 and, release the hammer 18 when the top edge of the disconnector 40 is moved by the rear of the bolt carrier 26. The disconnector 40 is substantially the same as in the prior art. Referring also to FIG. 4A, the leg 42, however, is different. The leg 42 has a bend 46, a bottom end 48 and a top end pivotally mounted on the pin 44. A spring (not shown) is provided on the pin 44 and between the leg 42 and the disconnector 40 to bias the bottom end 48 of the leg 42 towards the control cam 30. The leg 42 has a section that interacts with the disconnector 40 to limit its rotation on the pin 44 relative to the leg 42 in direction A. The control cam 30, at the fourth section 38, limits axial rotation of the leg 42 on pin 44 in direction A.

FIGS. 1, 2, 3 and 4A show the firearm 10 with the selector switch 16 at the "SAFE" position. The fourth section 38 forms an automatic sear control section as better understood from the description below. The control cam 30 has a general mushroom shaped cross-section at the fourth section 38. This general mushroom shape is demonstrated best by FIG. 4D. More specifically, as seen best in FIG. 4D, the cross-sectional shape has a dome section 50 and a stem section 52. The stem section 52 is located at a center axis C of the control cam 30 and is relatively short. The dome section 50 has an edge 54 between its curved top surface 56 and one of its undercut sections 58 that is curved. A second undercut section 60 is located on the opposite side of the stem 52.

Although sections 58 and 60 are called undercut sections, in a preferred embodiment the cam 30 is cast of metal with the sections 58, 60 therein. However, sections 58, 60 could be cut out of a column of material if desired. With the cam 30 in the "SAFE" position shown in FIG. 4A, the tip 48*a* of the leg's bottom end 48 contacts the curved surface 56. This limits the position of the leg 42 which, in turn, limits the position of the automatic sear disconnector 40 to the substantially vertical position shown. The bottom 40*b* of the disconnector 40 is too far back to interact with the rear of the hammer 18.

Figure 4B:
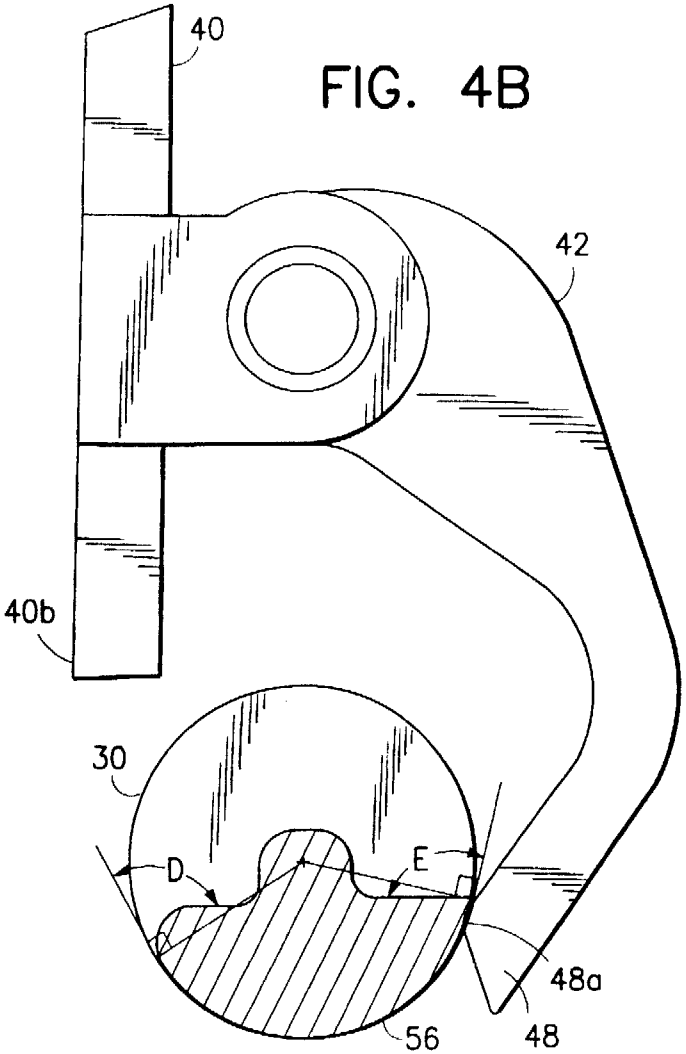
FIG. 4B is a schematic partial cross-sectional and side view as in FIG. 4A with the control cam and automatic sear at a semi-automatic firing position.
Figure 4A:
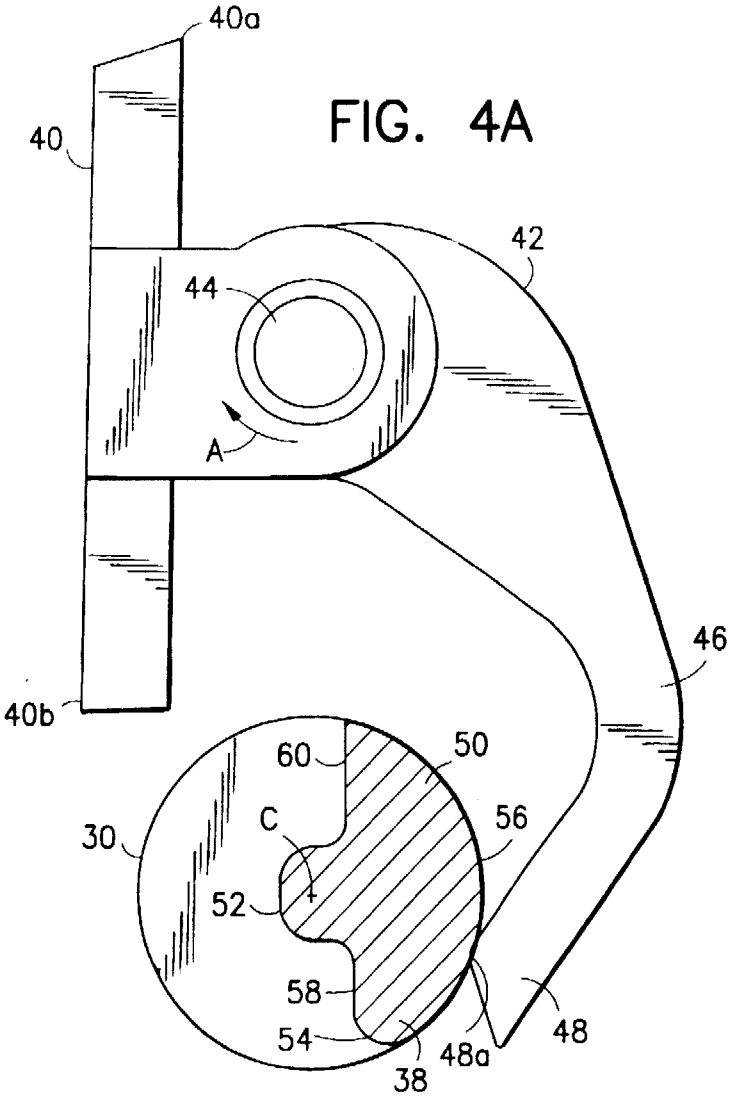
FIG. 4A is a schematic partial cross-sectional and side view of the control cam and automatic sear shown in FIG. 2 at a safe firing position.

When the selector switch 16 is rotated to the "SEMI" setting, the control cam 30 is rotated to the position shown in FIG. 4B. In this position the curved surface 56 still contacts the tip 48*a* of the leg's bottom end 48. Thus, the control cam 30 still limits the position of the leg 42 to limit the position of the automatic sear disconnector 40 to the inoperative substantially vertical position shown.

Figure 4D:
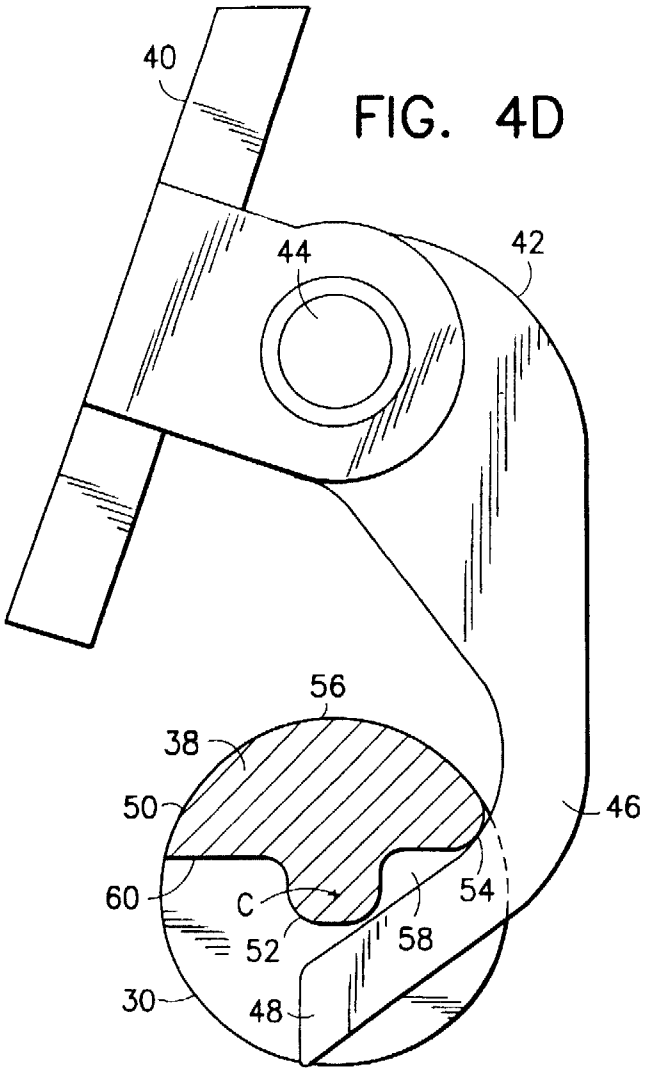
FIG. 4D is a schematic partial cross-sectional and side view as in FIG. 4C with the control cam and automatic sear at a fully automatic firing position.
Figure 4C:
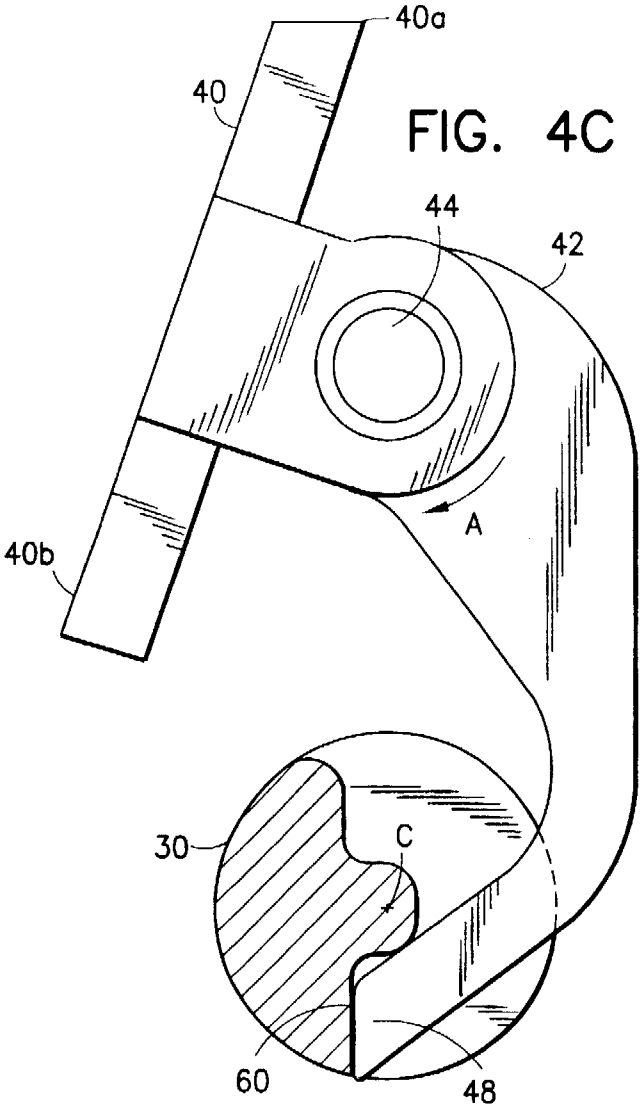
FIG. 4C is a schematic partial cross-sectional and side view as in FIG. 4B with the control cam and automatic sear at a limited automatic burst firing position.

When the selector switch 16 is rotated to the "BURST" setting, the control cam 30 is rotated to the position shown in FIG. 4C. In this position the leg's bottom end 48 has rotated forward into the area of the second undercut section 60. The bottom end 48 extends below and past the center axis C. Because the leg 42 has rotated on the pin 44 in direction A, the automatic sear disconnector 40 has also been allowed to rotate in direction A on the pin 44. As seen in comparing FIG. 4C to FIG. 4B, the disconnector moves from its substantially vertical position to an angled position with the bottom 40*b* of the disconnector 40 in a forward position. The bottom 40*b* is thus in position to catch the hammer 18. The top 40*a* of the disconnector 40 is in a suitable position to be moved by the bolt carrier 26. Thus, the disconnector 40 can be moved by the bolt carrier 26 to release the hammer 18 for limited burst automatic firing in conjunction with the ratchet disconnector 21.

When the selector switch 16 is rotated to the "FULL AUTO" setting, the control cam 30 is rotated to the position shown in FIG. 4D. In this position the leg's bottom end 48 is in the same position shown in FIG. 4C. The fourth section 38 is located above the bottom end 48. The leg 42 contacts the cam 30 at the curved edge 54. The curved edge 54 contacts the leg adjacent the bend 46 in the middle of the leg 42. The bend 46 is located substantially horizontally even with the top dome section 50 of the control cam 30. The automatic sear disconnector 40 has the same position in the "FULL AUTO" setting as in the "BURST" setting. As the control cam 30 is rotated between the position shown in FIG. 4C and the position shown in FIG. 4D, or vice versa, the control cam 30 does not significantly move the leg 42. Therefore, the automatic sear disconnector 40 is not significantly moved. In an alternate embodiment, such as an open bolt firearm, this can prevent the automatic sear from inadvertently releasing a caught hammer.

When the selector switch 16 is rotated back to the "SAFE" position of FIG. 4A, the curved edge 54 pushes the leg 42 backward in a direction reverse to direction A. The leg 42, in turn, pushes the automatic disconnector 40 back to a substantially vertical position in a direction reverse to direction A. The control cam 30 can be rotated clockwise and counterclockwise to move from firing selections including safe, semi-automatic, limited automatic burst, fully automatic and back to safe or, from safe to fully automatic, to burst, to semi-automatic and back to safe. The cross-sectional shape of the fourth section 38 of the cam 30 and the shape of the leg 42 have been designed to provide this feature. As seen in looking at FIGS. 4A–4D, the bottom end 48 contacts the curved surface 56 of the dome 50 in two positions of the cam 30; FIGS. 4A and 4B. The bottom end 48 contacts the bottom of the dome 50 at undercut area 60 in one position of the cam 30; FIG. 4C. The bottom end 48 does not contact fourth Section 38 in one position; FIG. 4D. Rather, the leg 42 contacts the cam 30 adjacent the bend 46 in the position shown in FIG. 4D. As seen in FIG. 4B, the main part of the first undercut section 58 is angled relative to the tangent at an angle D of about 104°. The second undercut section 60 is angled relative to the tangent at an angle E of about 102°. In alternate embodiments other types of angles could be provided. The cross-sectional shape of the fourth section 38 provides a sufficiently large cross-sectional area to provide good strength for the cam 30 at the area 38. This strength will prevent the cam 30 from being damaged from repeated and perhaps roughed use. The present invention also provides a four position firearm selector that does not infringe U.S. Pat. No. 5,251,533.

It should be understood that the foregoing description is only illustrative of the invention. Various alternatives and modifications can be devised by those skilled in the art without departing from the spirit of the invention. Accordingly; the present invention is intended to embrace all such alternatives, modifications and variances which fall within the scope of the appended claims.

What is claimed is:

1. In a firearm having a trigger, a hammer, an automatic sear, and a selector switch connected to a rotatable firing control cam for selecting among types of firing selections of the firearm, the types of firing selections including safe, semi-automatic, limited automatic burst, and fully automatic, the rotatable firing control cam having an automatic sear control section that is contacted by a leg from the automatic sear, wherein the improvement comprises:

the automatic sear control section of the control cam having a general mushroom cross-sectional shape with a dome section and a stem section.

2. A firearm as in claim 1 wherein the stem section is located at a center of the control cam and is shorter than the dome section.

3. A firearm as in claim 1 wherein one edge of the dome section between a curved top surface and an undercut section is curved.

4. A firearm as in claim 1 wherein the control cam has two undercut sections located on opposite sides of the stem section.

5. A firearm as in claim 1 wherein the leg has a bend near a middle of the leg with the control cam contacting the leg adjacent the bend in at least one position of the control cam.

6. A firearm as in claim 1 wherein the leg has a bottom end that extends below a center of the control cam in at least one position of the control cam.

7. In a firing control mechanism having an automatic sear, a leg connected to the automatic sear, a selector switch, and a rotatable firing control cam connected to the selector switch and having the leg riding thereon, wherein the improvement comprises:

the leg having a bend near a middle of the leg with the control cam contacting the leg adjacent the bend in at least one position of the control cam, wherein the means for moving comprises an automatic sear control section of the control cam having a general mushroom shape.

8. A firing control mechanism as in claim 7 wherein the leg has a bottom end that extends below a center of the control cam in at least one position of the control cam.

9. A firing control mechanism as in claim 8 wherein the leg has a bottom end that extends below a center of the control cam in at least two positions of the control cam.

10. In a firearm having a trigger, a hammer, an automatic sear, and a selector switch connected to a rotatable firing control cam for selecting among types of firing selections including safe, semi-automatic, limited automatic burst, and fully automatic, the rotatable firing control cam having an automatic sear control section that is contacted by a leg from the automatic sear, wherein the improvement comprises:

means for moving the control cam between a burst position and a fully automatic position, wherein the means for moving comprises the control cam having a general cross-section mushroom shape.

11. A firearm as in claim 10 wherein the leg has a bend located substantially horizontally even with a top section of the control cam.

12. A firearm as in claim 11 wherein the leg has a bottom end for contacting the control cam in two positions of the control cam.

* * * * *